US009863592B2

(12) United States Patent
Toner

(10) Patent No.: US 9,863,592 B2
(45) Date of Patent: Jan. 9, 2018

(54) LIGHTING UNIT

(71) Applicant: Gary L. Toner, Lancaster, NY (US)

(72) Inventor: Gary L. Toner, Lancaster, NY (US)

( * ) Notice: Subject to any disclaimer, the term of this patent is extended or adjusted under 35 U.S.C. 154(b) by 17 days.

(21) Appl. No.: 15/163,769

(22) Filed: May 25, 2016

(65) Prior Publication Data

US 2016/0348863 A1 Dec. 1, 2016

Related U.S. Application Data

(60) Provisional application No. 62/166,787, filed on May 27, 2015.

(51) Int. Cl.

| | |
|---|---|
| ***F21L 4/00*** | (2006.01) |
| ***F21S 9/03*** | (2006.01) |
| ***G09F 17/00*** | (2006.01) |
| ***E04H 12/00*** | (2006.01) |
| ***F21V 33/00*** | (2006.01) |
| ***E04H 15/62*** | (2006.01) |
| *F21Y 115/10* | (2016.01) |

(52) U.S. Cl.

CPC ..... *F21S 9/035* (2013.01); *E04H 12/00* (2013.01); *E04H 15/62* (2013.01); *F21V 33/00* (2013.01); *G09F 17/00* (2013.01); *F21Y 2115/10* (2016.08)

(58) Field of Classification Search

CPC .... F21L 4/00; F21L 13/00; F21V 9/16; B60Q 1/26

USPC ..... 362/183, 157, 84, 227

See application file for complete search history.

(56) References Cited

U.S. PATENT DOCUMENTS

| | | | | |
|---|---|---|---|---|
| 8,585,231 | B1 * | 11/2013 | May | F21S 9/037 362/1 |
| 2006/0023446 | A1 * | 2/2006 | Racoosin | G09F 17/00 362/227 |
| 2010/0175318 | A1 * | 7/2010 | Ahmadi | A01G 7/045 47/66.6 |
| 2012/0201017 | A1 * | 8/2012 | Lamm | F21S 9/037 362/183 |
| 2012/0314404 | A1 * | 12/2012 | Harshaw | F21S 9/037 362/183 |
| 2015/0216273 | A1 * | 8/2015 | Akin | A45B 25/00 135/16 |

* cited by examiner

*Primary Examiner* — Edwyn Labaze

(74) *Attorney, Agent, or Firm* — Del Vecchio and Stadler LLP

(57) ABSTRACT

A lighting unit is provided that has a housing with a lighting portion and a solar panel portion. Solar panels are mounted on the solar panel portion and the energy gathered by the solar panels is stored in a rechargeable battery. The lighting portion has a conical shaped wall that meets with a circular shaped wall. Each of the conical shaped wall and circular shaped wall defines light recesses defined by light recess walls, and an LED is disposed in each recess. The LEDs are powered by the rechargeable battery and are capable of illuminating a flag whether or not there is a breeze or wind. The circular shaped wall defines a wall opening and the solar panel portion has pole extension that is fitted in the wall opening. A flagpole extends through the pole extension and the lighting unit is mounted on the flagpole

13 Claims, 6 Drawing Sheets

LIGHTING UNIT

CROSS REFERENCE TO RELATED APPLICATION

This application claims the benefit of provisional U.S. Patent Application No. 62/166,787 filed on May 27, 2015 the entire contents and disclosure of which are hereby incorporated herein by reference.

BACKGROUND

People enjoy displaying flags in their yards and at their businesses. The flags may be the U.S. flag, the flags of other nations, or flags that display business names or logos. However, as night falls there is no source of light to illuminate the flags so that they can be seen.

There are methods for lighting flags at night, for example ground lights that emit beams of light in a direction toward the flag. However, the owner often has to provide lights and attach them to a suitable support, and then hardwire the lights to the power grid. This becomes costly over time and the many owners of such lights simple stop using them to save money. There are also lighting devices are that powered with solar power, but to date such lighting devices are ineffective at beaming the light to where it is needed. For example, such existing solar lights will send a beam of light directly down the flagpole and will illuminate a portion of the flag and in some instances almost none of the flag depending how the wind is blowing the flag. These lights are simply incapable of illuminating the flag if there is wind or a breeze and the flag is waving in the wind. Thus, these devices fail to illuminate the most beautiful aspects of a flag, namely when it is waving in the wind at night.

What is needed is an improved lighting device that can be mounted on flagpole and that is capable of illuminating the flag at all times, that is, when the flag is still and when it is being moved by the wind. The lighting device needs to be easy to manufacture, inexpensive, easy install and have a long working life.

SUMMARY

A lighting unit is provided that has a housing, and the housing includes a base portion and a solar panel support portion. The base portion and solar panel support portion are connected with, for example, fasteners to define a housing interior, and the solar panel support portion has a circular shape in one of the preferred embodiments. The lighting unit also has solar panels that are supported on the solar panel support portion. The solar panel support portion has a finial receiving extension that extends through the housing interior. The finial receiving extension defines a finial receiving interior that is sized such that a support shaft of a flagpole finial can be passed through the finial receiving extension. This allows the lighting unit to be mounted on a flagpole.

The lighting unit also includes a rechargeable battery along with associated circuitry, wiring and light emitting diodes (hereinafter referred to as LEDs herein) that are disposed in a housing interior defined in the housing. Solar energy is stored in the rechargeable battery and then emitted when it is dark by light emitting diodes (LEDs) or light bulbs. The solar light circuitry controls the process of using the energy gathered by the solar panels and stored in the rechargeable battery to power the LEDs when it is dark.

The base portion of the housing has a conical shaped wall that meets with a base wall, and the base wall has a circular shape. The diameter of the base wall is less than the diameter of the solar panel support portion. The conical shaped wall extends to the base wall and is tapered inwardly as it extends from the solar panel support portion to the base wall. The conical shaped wall and the base wall are formed as a one-piece body in one of the preferred embodiments, such that the base portion is one piece. The base wall has base recess walls that define base recesses and LEDs are disposed in base recesses. The conical shaped wall has a recess walls that define recesses and LEDs are disposed in the recesses.

Thus, LEDs are supported by both the conical shaped wall and base wall. The lighting unit is supported on the flag end of a flagpole. Light is emitted from the LEDs such that the flag is primarily illuminated by the LEDs supported by the base wall when there is no breeze, and when there is a breeze the flag is illuminated by the LEDs supported by the base wall and the LEDs supported by the conical shaped wall. Thus, the user or an observer can see the illuminated flag at all times, regardless of whether there is or is not a breeze.

BRIEF DESCRIPTION OF THE DRAWING FIGURES

DESCRIPTION

Figure 1:
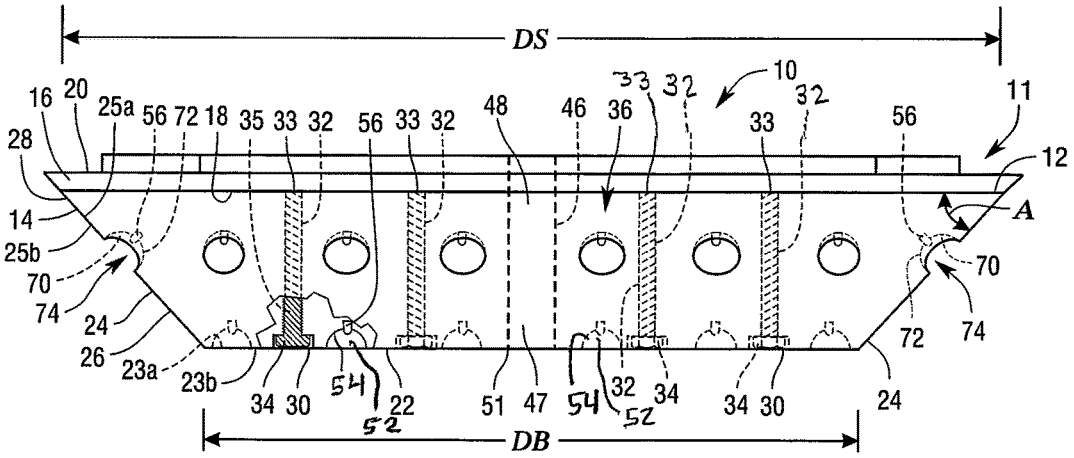
FIG. 1 is a side view of a lighting unit.
Figure 2:
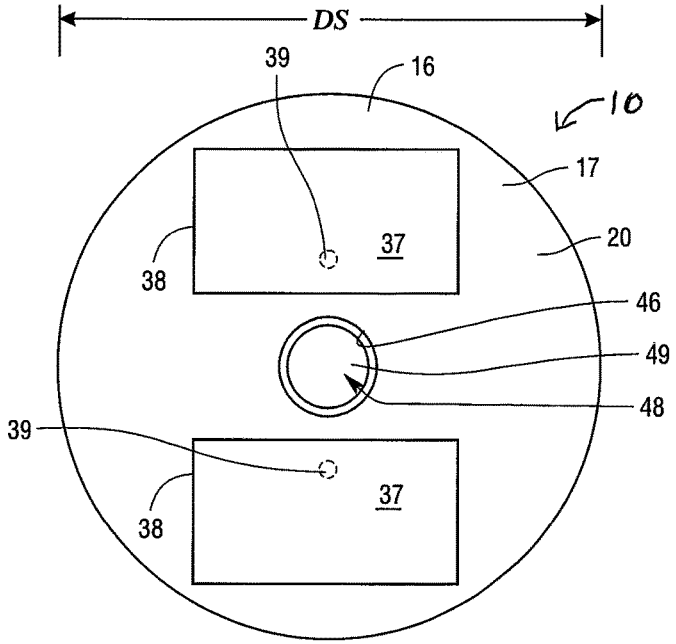
FIG. 2 is a top view of the lighting unit.

As shown in FIG. 1 there is a lighting unit 10 having a truncated cone shape 11. The lighting unit 10 includes a housing 12. The housing 12 has a base portion 14 and a solar panel support portion 16 that is supported on the base portion 14. As shown in FIG. 2, the solar panel support portion 16 is has a circular shape 17 in one of the preferred embodiments and is flat. The solar panel support portion 16 has opposed interior and exterior surfaces 18, 20 and is made of plastic, and may be made of metal and other suitable materials in other preferred embodiments. The solar panel support portion 16 has a diameter designated DS in FIG. 2, and DS is about ten to about twelve inches in diameter. In other preferred embodiments DS may be less than ten inches in diameter or more than twelve inches in diameter.

The base portion 14 of the housing 12 has a base wall 22 that has a circular shape and has interior and exterior base wall surfaces 23*a*, 23*b*. The base portion 14 also has a conical shaped wall 24 that extends from the base wall 22. The conical shaped wall 24 has interior and exterior conical wall surfaces 25*a*, 25*b*. The base wall 22 and the conical shaped wall 24 are formed as a one-piece body 26 and are plastic, but may be may be made of metal in other preferred embodiments. It is pointed out that the conical shaped wall 24 abuts against the solar panel portion 16.

The conical shaped wall 24 extends from the base wall 22 to a conical shaped wall edge 28. It is pointed out that the diameter of the conical shaped wall 24 as measured at the conical shaped wall edge 28 is the same or substantially the same as the diameter of designated DS of the solar panel support portion 16 shown in FIG. 2. Thus, when the solar panel support portion 16 is mounted on the conical shaped wall 24 the solar panel support portion 16 and the conical shaped wall 24 are flush or substantially flush with one another. It is further pointed out that the diameter of the conical shaped wall 24 as measured at the conical shaped wall edge 28 is greater than the diameter of the of the base wall 22 designated DB in FIG. 1. Thus, the conical shaped wall 24 is tapered inwardly as it extends to the base wall 22. In other words, the diameter of the conical shaped wall 24 decreases as it extends from the conical shaped wall edge 28 to the base wall 22.

Figure 1A:
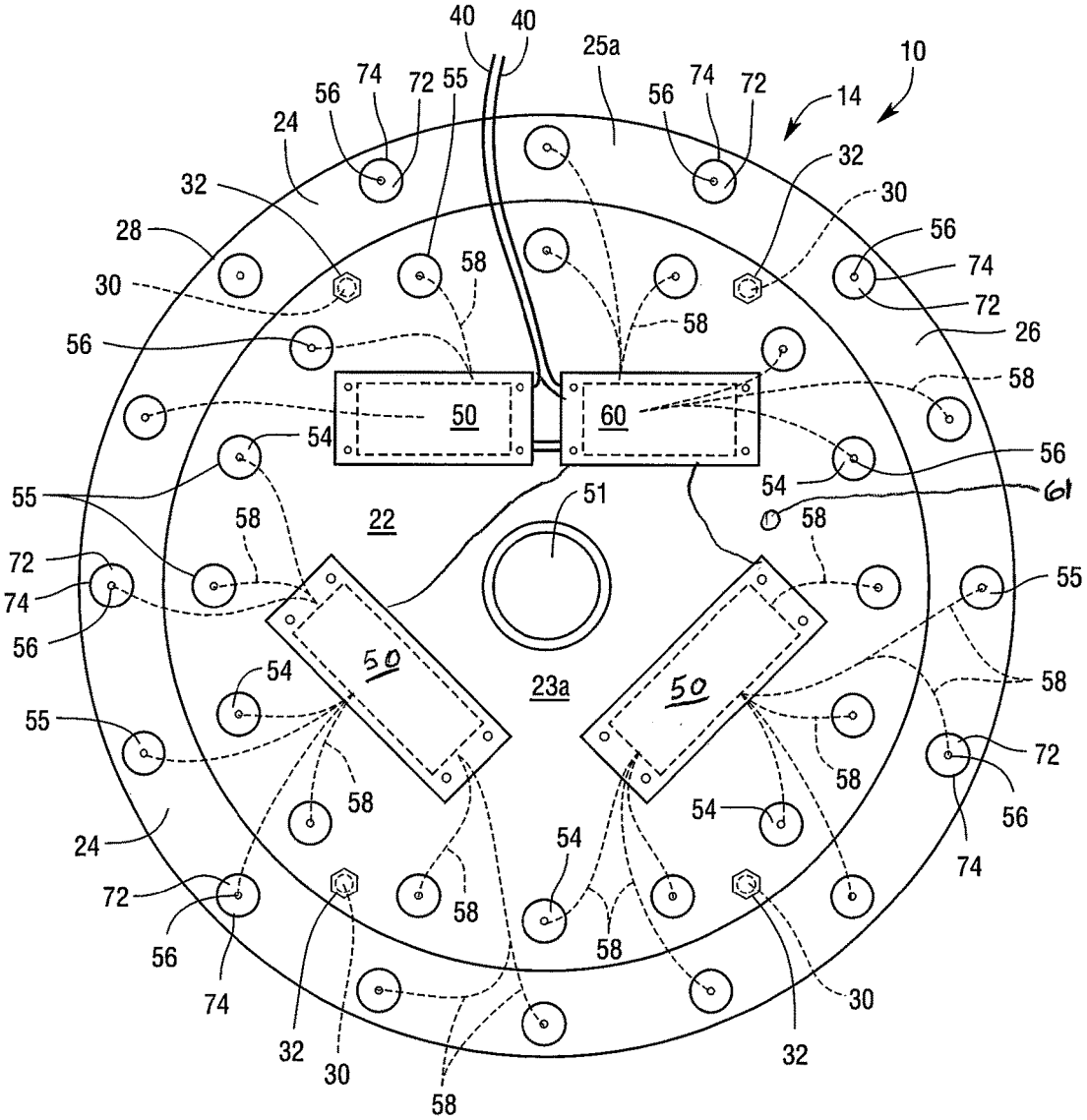
FIG. 1A is a top view of the lighting unit wherein the interior of the lighting unit is shown.

FIG. 1A is a top view of the base portion 14 wherein the solar panel support portion 16 is not present. The base wall 22 defines fastener openings 30, and internally threaded bores 33 (FIG. 1) extend from the interior surface 18 of solar panel support portion 16 into the solar panel support portion 16. Fasteners 32 having threaded portions 35 are provided. The threaded portions 35 extend through the fastener openings 30 defined in the base wall 22 and the heads 34 of the fasteners 32 abut against the base wall 22. The treaded portion 35 are threaded to the internally threaded bores 33 formed in the solar panel portion 16 thus connecting the base wall 22 and solar panel portion 16. When so connected, the conical shaped wall edge 28 abuts against the solar panel portion 16 and the solar panel portion 16 and the base portion 14 are held together. When the solar panel support portion 16 is so mounted on the base portion 14 the solar panel support portion 16 and base portion 14 together define a housing interior 36.

As shown in FIG. 2 the lighting unit 10 also includes solar panels 37, with two solar panels 37 shown. The solar panels 37 are connected to the housing 12 and in particular to the exterior surface 20 of the solar panel support portion 16. It is to be understood that the number of solar panels 37 may be more or less than two, and that solar panels (shown as rectangular in the figures) may be otherwise shaped. Adhesives 38 are used to secure the solar panels 37 to the solar panel portion 16 and the adhesives 38 are waterproof adhesives in one of the preferred embodiments. The solar panels 37 can be connected or mounted on the solar panel support portion 16 in other ways well know to those having ordinary skill in the art. The solar panel support portion 16 also defines wire openings 39 and solar panel wires 40 (FIG. 1A) extend from the solar panels 37 and through the wire openings 39.

Figure 5:
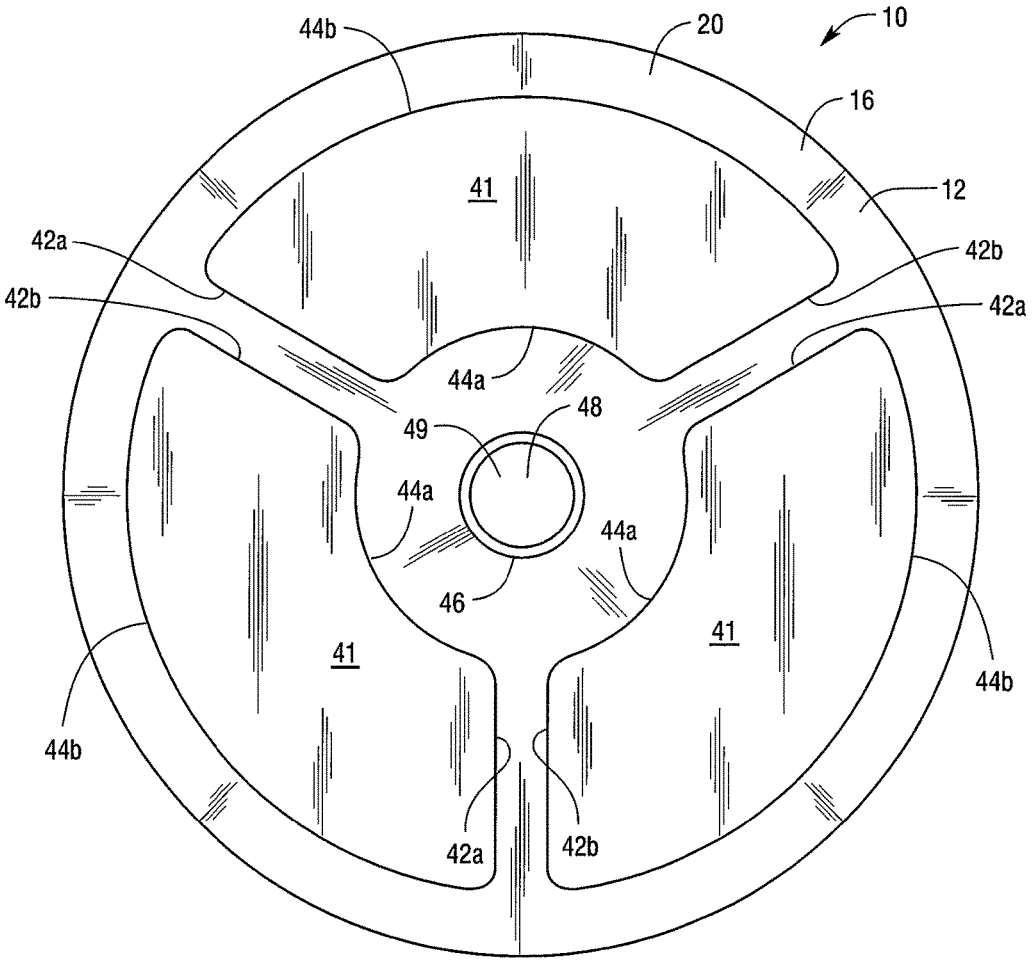
FIG. 5 is a top view of another embodiment of the solar panels.

FIG. 5 shows another preferred embodiment illustrating solar panels that are embodied in different shapes. For example, the solar panels 37 shown in FIG. 2 are rectangular shaped solar panels. As shown in FIG. 5, the solar panels are embodied as curved shaped solar panels 41 with each curved shaped solar panel 41 having opposed panel edges 42*a*, 42*b*, that are linear, and each has opposed concave and convex edges 44*a*, 44*b*. The curved shaped solar panels 41 mimic the circular shape 17 of the solar panel portion 16. It is to be understood that the shape of the solar panels 37 can be made to have virtually any shape in other preferred embodiments, for example they may be circular shaped or oval shaped.

As shown in FIGS. 1-3 and 5, the solar panel support portion 16 has a finial receiving extension 46 that is centrally disposed in the solar panel support portion 16. The finial receiving extension 46 extends to a finial extension end 47. The finial receiving extension 46 defines a finial opening 48 that leads to a finial extension interior 49. As will be described presently, a flagpole finial 120 having a support shaft 122 is provided (FIG. 4A), and the finial opening 48 and the finial extension interior 49 are sized to receive the support shaft 122 therein. As shown in FIG. 1A, the base wall 22 defines a finial extension opening 51 sized to allow the finial extension end 47 to pass therethrough. In one of the preferred embodiments the finial extension end 47 is flush and may be substantially flush with the exterior base wall surface 23*b*.

As previously described, when the solar panel support portion 16 and the lighting portion 14 are connected to one another together they define a housing interior 36. As shown in FIGS. 1 and 1A, disposed in the housing interior 36 is a rechargeable battery 50 and it is pointed out that there may be more than one rechargeable battery 50 as shown. Also disposed in the housing interior 36 are LEDs 56, solar light circuitry 60 that includes a light sensor and test button circuitry, and solar panel wires 40 that wired to the solar panels 37 and solar light circuitry 60, and power wires 58 that carry electrical power stored in the rechargeable battery 50 to the LEDs 56. It is pointed only some of the wiring is not shown in the drawings figures for the sake of clarity, it being understood that there are power wires 58 leading to each of the LEDs 56 so that they can be powered. The solar light circuitry 60 controls the charging and discharging of the rechargeable battery 50 and the turning on and off of the LEDs 56 based on ambient light detection. There is a test button 61 mounted to the base wall 22 that allows the user to test if the LEDs 56 function properly. Thus, when ambient or environmental light falls to a predetermined level as detected by the solar light circuitry 60 the LEDs 56 are powered. In other preferred embodiments the solar light circuitry 60 includes a timer to control the time when the LEDs 56 are powered and not powered. It is pointed out that solar panels, LED's, rechargeable batteries, and solar panel circuitry used in connection with solar panels and rechargeable batteries and LED's are well know to those having ordinary skill in the art and is therefore their construction, use and operation are not described in greater detail herein. The rechargeable battery 50 is 3.7V and 3500 mAh to 5400 mAh in one of the preferred embodiments, and the solar panels 37 are 5V and 420 mAh in one of the preferred embodiments. It is to be understood that the voltages and amperages can be different in other preferred embodiments and the invention is not limited to the voltages and amperage described above.

Figure 3:
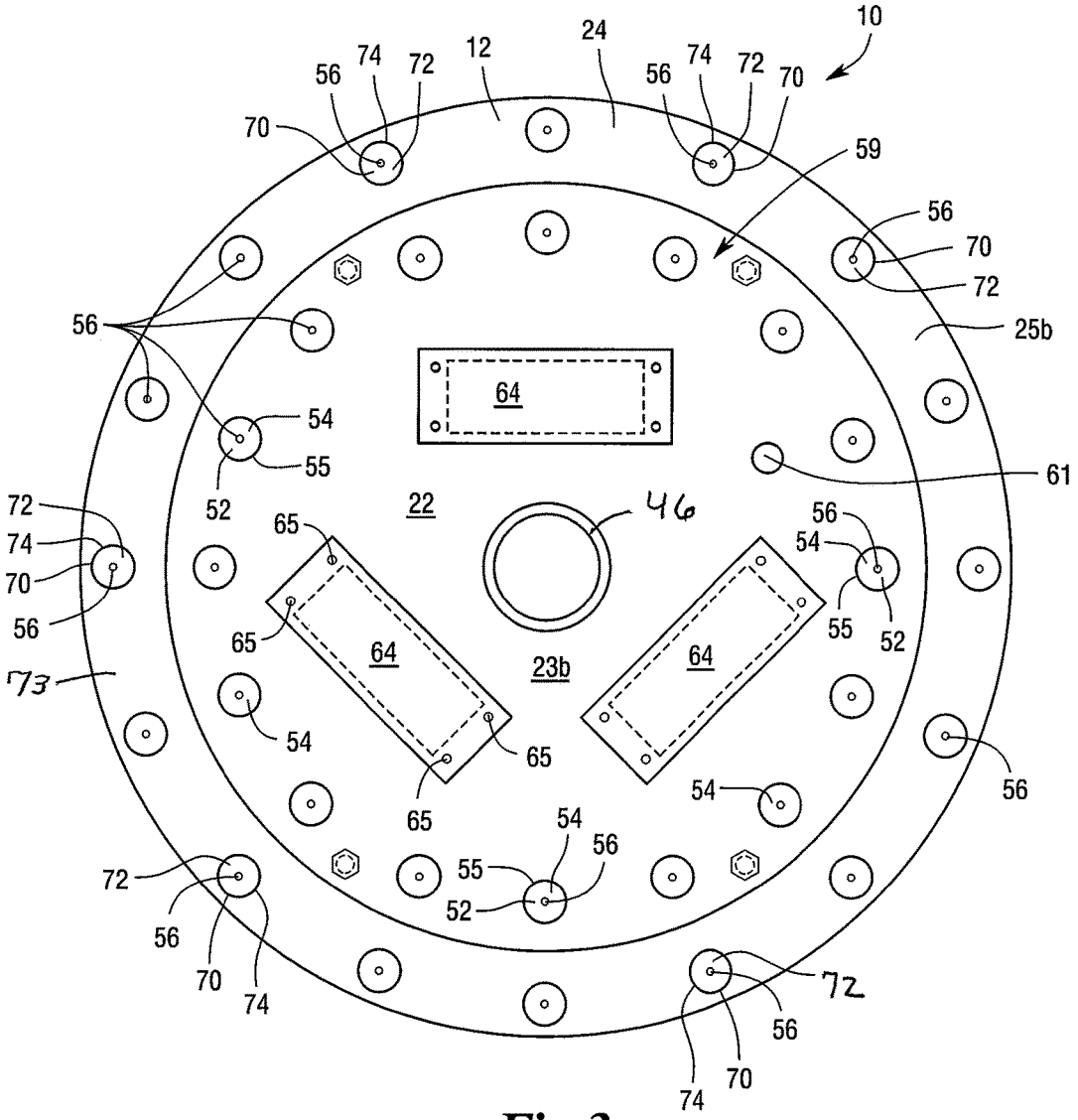
FIG. 3 is a bottom view of the lighting unit.
Figure 4A:
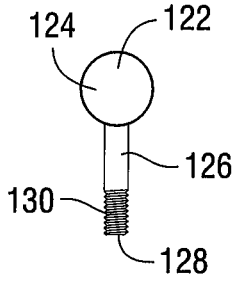
FIG. 4A is a front view of a flagpole finial.

As shown in FIGS. 1, 1A and 3 and the base wall 22 has a plurality of base recesses 52 that are defined by base recess walls 54. The base recess walls 54 extend inwardly from the exterior base wall surface 23*b* and protrude from the interior base wall surface 23*a* into the housing interior 36. The base recess walls 54 may be conical shaped or cone shaped in one of the preferred embodiments such that the base recesses 52 are conical shaped, and in other preferred embodiments they may sphere shaped. Each of the base recess walls 54 defines a base recess wall opening 55. Disposed in each of the base recess wall openings 55 is an LED 56 or other light source, for example a light bulb. The LEDs 56 are held in place with a friction fit or with adhesives or otherwise engage the base recess wall 54. As shown in FIG. 3 which is a bottom view of the lighting unit 10, the base recess walls 54 are arranged in the shape of a circle 59 and extend inwardly into the housing interior 36 as shown in FIG. 1 such that the LED's 56 are recessed relative to the exterior base wall surface 23*b*. The LEDs 56 may be embodied to emit white light or light of virtually any color. In other preferred embodiments the LEDs 56 can be embodied to flash. It is pointed out that in the drawing figures not all of the LEDs 56, base recess walls 54, base recess wall openings 55 and base recesses 52 have been numbered for the sake of clarity. LEDs and their use and operation are well known to those having ordinary skill in the art and therefore they are not described in greater detail herein. In one of the preferred embodiments there are there are sixteen (16) base recesses 52 defined in the base wall 22, but there may be more or less in other preferred embodiments. As shown in FIG. 1A, each of the LEDs 56 is wired to the solar light circuitry 60 with LED wires 58 such that each LED 56 is powered by the rechargeable battery 50. Not all the LED wires are shown for the sake of clarity.

As shown in FIG. 3, the base wall 22 may also support at least one access panel 64 with three access panels 64 shown. Access panel screws 65 are used to connect the access panels 64 to the base wall 22 so that the access panels 64 can be installed and removed.

The access panels 64 provide access to the housing interior 36 and so that the solar light circuitry 60 and other above-described components disposed in the housing 12 so that they can be accessed, maintained and replaced. It is pointed out that the access panels 64 are not shown in FIG. 1A for the sake of clarity. The user may also gain access to the housing interior by removing the above-described fasteners 32.

As shown in FIGS. 1, 1A and 3, the conical shaped wall 24 also has a plurality of recesses 70 that are defined by recess walls 72. As shown in FIG. 1A, the recess walls 72 extend inwardly from the exterior conical shaped wall surface 25*b* and protrude from the interior conical shaped wall surfaces 25*b* and into the housing interior 36. The recess walls 72 may be conical shaped in one of the preferred embodiments such that the recesses 70 have a conical shape. Each of the recess walls 72 defines a recess wall opening 74. Disposed in each of the recess wall openings 74 is an LED 56, or some other light source, for example a light bulb. As shown in FIG. 3 the recess walls 72 are arranged so as to form the shape of a ring 73 that extends around the conical shaped wall 24. In one of the preferred embodiments the recess walls 72 are spaced equal distances from one another. In another preferred embodiment the recess walls 72 are spaced equal distances from one another and each is spaced an equal distance from the conical shaped wall edge 28 and the base wall 22. It is pointed out that in the drawing figures not all the LEDs 56, recesses 70, and the recess walls 72 are numbered for the sake of clarity. In one of the preferred embodiments there are there are sixteen (16) recesses 70 defined in the conical shaped wall 24, but there may be more or less in other preferred embodiments.

The interior conical shaped wall surface 25*a* makes an angle designated A in FIG. 1 relative to the interior surface 18 of solar panel support portion 16, and angle A is an acute angle. Thus, the conical shaped wall 24 slopes inwardly, that is, the conical shaped wall 24 is tapered as is extends to and meets with the base wall 22. In one of the preferred embodiments angle A is forty-five degrees (45°), but could be more or less than 45° in other preferred embodiments. Thus, the light emitted from the LEDs 56 supported by the conical shaped wall 24 is emitted outwardly from the lighting unit 10 and at a 45° angle relative to the light emitted from the LEDs 56 supported by the base wall 22. This providing for full and complete illumination of a flag 102 as will be described presently.

Figure 4B:
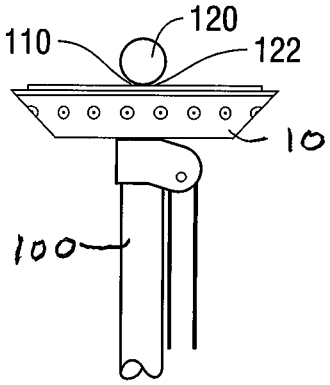
FIG. 4B is a front view of the lighting unit supported on a flagpole.
Figure 4:
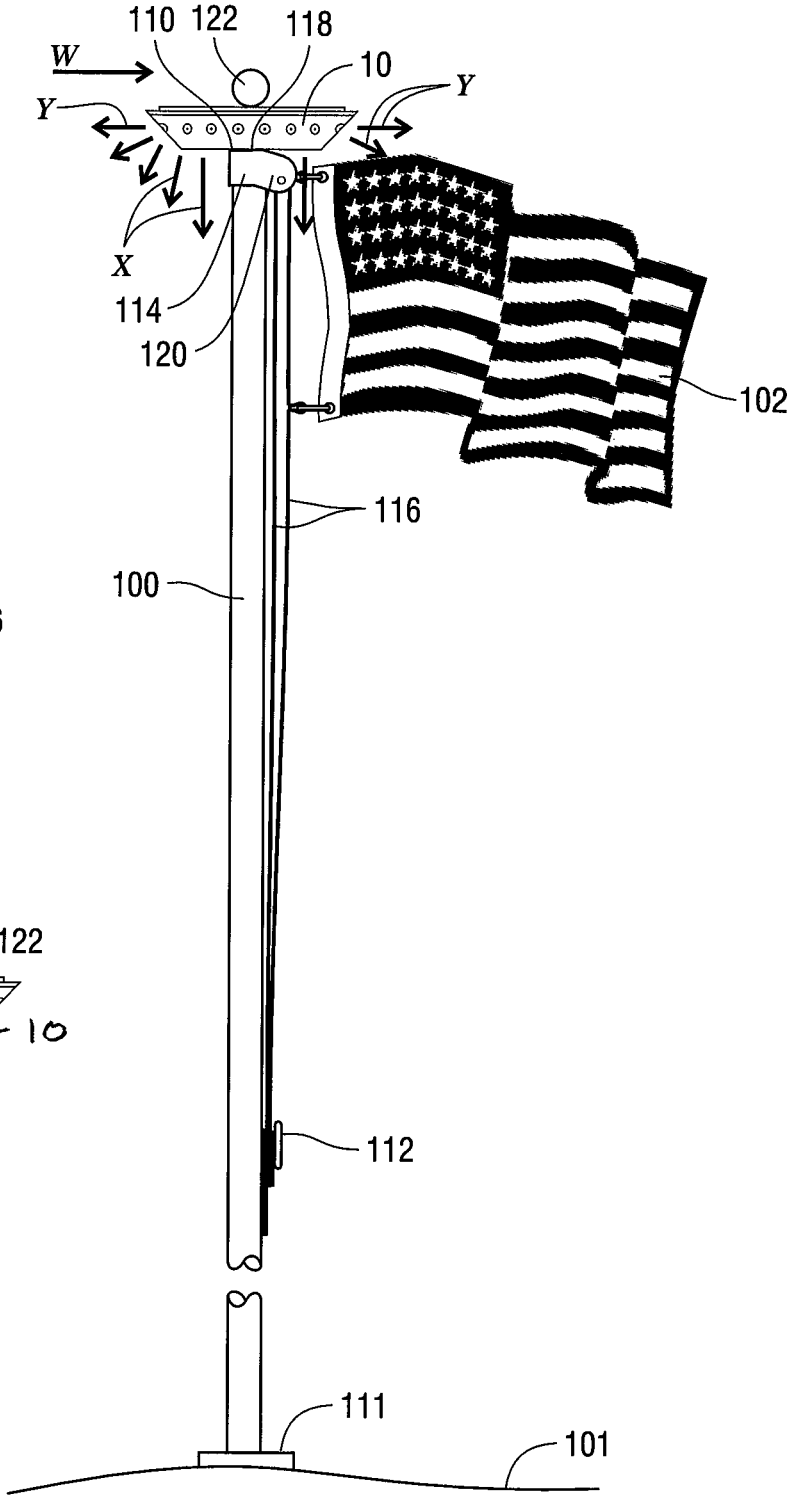
FIG. 4 is a perspective view of the lighting unit mounted on flagpole.
Figure 6:
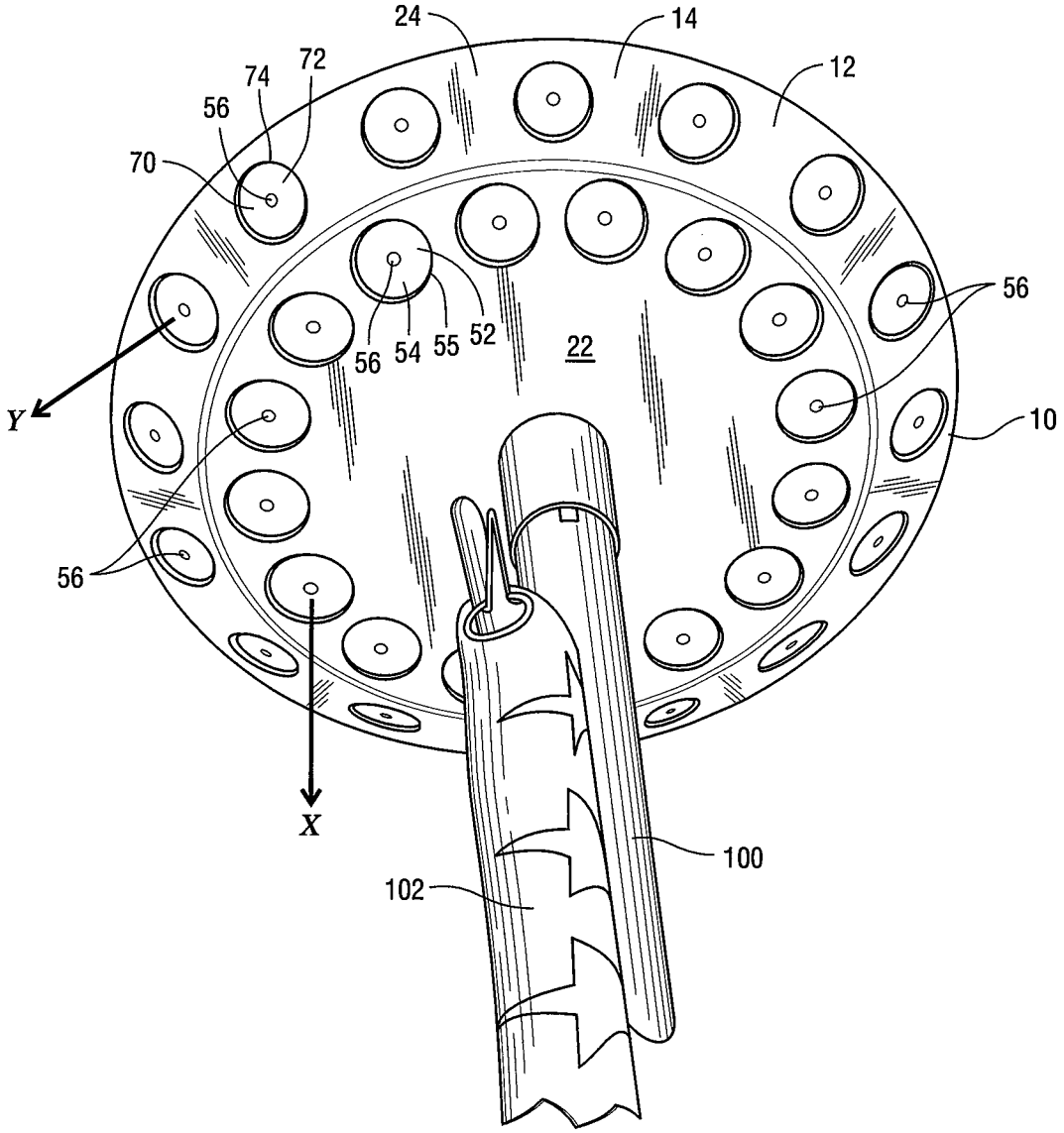
FIG. 6 is a perspective view of the lighting unit wherein the lighting unit is illuminating a flag at night.

The lighting unit 10 is capable of being used in connection with a flagpole 100 as shown in FIGS. 4, 4A, 4B and 6. FIG. 4 is a perspective view of the above-described lighting unit 10 mounted on a flagpole 100 when the lighting assembly 10 is emitting light and illuminating the flag 102 that is supported by a flagpole 100, and the flagpole is supported in the ground 101. FIG. 6 is an enlarged view of the lighting unit 10. The flagpole 100 has a flag end 110 and an opposed ground end 111 for insertion into the ground 101. A rope cleat 112 is mounted on the flagpole 100. A pulley assembly 114 is supported on the flag end 110 of the flagpole 100. A rope 116 is provided and is threaded through by the pulley assembly 114, and the flag 102 is connected to the rope 116 such that pulling the rope 116 raises and lowers the flag 102. Pulley assemblies for use in connection with flagpoles and ropes for raising and lowing flags are well know to those having ordinary skill in the art and are therefore not described greater detail herein. The pulley assembly 114 is supported on the flagpole 100 with a friction fit, or it may be held in place with a fastener that extends through the pulley assembly 114 and flagpole 100. The pulley assembly 114 has a flagpole finial opening 118 that has an internal pulley thread 120. As shown in FIGS. 4-4BA flagpole finial 122 is provided that has a an ornamental portion 124 and a support shaft 126, with the support shaft 126 extending from the ball portion 124. It is pointed out that the ball portion 124 can be differently shaped in other preferred embodiments, for example it may have the shape of an eagle. Thus, as used herein, the term ball portion 124 is not limited to a ball or sphere shape, but rather, it includes all shapes and designs used for flagpole finials such as eagles, logos, and the like. The support shaft 126 has distal end 128 and an external shaft thread 130 extends from the distal end 128 and along the support shaft 126. The external shaft thread 130 is sized such that it is capable of being threaded to the internal pulley thread 120, such that when support shaft 126 is threaded to the internal pulley thread 120 the flagpole finial 122 extends vertically from the flag end of 110 of the flagpole 100. Flagpoles, finials and mounting finials on flagpoles, and pulleys for use with flagpoles having finials are all well known to those having ordinary skill in the and are therefore not described in greater detail herein.

The lighting unit 10 is supported and disposed above the flag 102. In particular, the finial opening 48 defined in finial receiving extension 46 of the lighting unit 10 is aligned with the flagpole finial opening 118. The support shaft 126 is then moved through the finial opening 48. The external shaft thread 130 is threaded to the internal pulley thread 120, such that the lighting unit 10 is disposed between the ball portion 124 of the flagpole finial 122 and the pulley assembly 114 and securely supported by the flagpole 100. This allows the lighting unit 10 to be readily installed and removed by the owner of the flagpole 100.

The lighting unit 10 provides for thorough and complete illumination of the flag 102 because light is emitted in two different directions as shown in FIGS. 4 and 6. As shown, some of the light is cast vertically downward toward the ground 101 and some the light is cast at an angle downward in the direction of the ground 101 by the light that is emitted by the LEDs 56 supported by the base wall 22 (as indicated by the arrows designated X). At the same time light emitted from the LEDs 56 supported by the conical shaped wall 24 (as indicated by the arrows designated Y) is at about a forty-five degrees) (45°) angle relative to the flagpole 100. It is pointed out that the base recess walls 54 and the recess walls 72 focus or direct the light emitted from the LEDs 56. The light emitted by the LEDs 56 will scatter to some extent after passing beyond the base wall 22 and the conical shaped wall 24. Thus the LEDs 56 supported by the base wall 22 illuminate the flag 102 when there is no wind and the flag 102 is simple hanging from the flagpole 100. When there is a breeze or wind and the flag 102 begins to wave in the wind (designated W in FIG. 4) the flag 102 is blow out and away from the flagpole 100. The LEDs 56 that are supported on the conical shaped wall 24 cast or emit light on the waving flag 102 (as indicated by the arrows designated Y). At the same time, the LEDs 56 supported by the base wall 22 illuminate portions of the flag 102. Thus, the flag 102 is fully illuminated by the lighting unit 10 throughout the night, regardless of whether or not there is or is not a breeze or wind. The rechargeable batteries 50 are capable of illuminating the flag 102 for twelve (12) or more hours.

In another preferred embodiments the lighting unit 10 can be differently shaped. That is, the solar panel support portion 16 and base wall 22 can be made to have virtually any desired geometrical shape. For example they can be rectangular shaped, oval shaped, and polygonal shaped. The conical shaped wall would be tapered and would have a geometry or shape that mimics the geometry or shape of the solar panel support portion and base wall. All of these embodiments are within the scope of the lighting unit 10.

In another preferred embodiment the lighting unit 10 can be mounted on, for example a post and secured in place with a bolt that extends through the finial receiving extension 46.

It will be appreciated by those skilled in the art that while a lighting unit 10 has been described in connection with particular embodiments and examples, the lighting unit 10 is not necessarily so limited and that other examples, uses, modifications, and departures from the embodiments, examples, and uses may be made without departing from the lighting unit 10. All these embodiments are intended to be within the scope and spirit of the appended claims.

What is claimed:

1. A lighting unit comprising:

a housing having a solar panel support portion and a base portion and the solar panel support portion supports a solar panel and the solar panel support portion is supported on the base portion and the solar panel support portion and the base portion define a housing interior;

the base portion has a base wall having opposed interior and exterior base wall surfaces and a conical shaped wall having interior and exterior conical wall surfaces;

the base wall has a base recess wall that protrudes from the interior base wall surface and into the housing interior and wherein the base recess wall defines an base recess wall opening that leads to the housing interior;

the conical wall has a recess wall that protrudes from the interior conical wall surface and into the housing interior and wherein the recess wall defines a recess wall opening that leads to the housing interior;

and wherein the solar panel support portion has an interior surface and the interior conical shaped wall surface has an interior conical shaped wall surface, and the interior surface and interior conical shaped wall surface are at an acute angle;

light emitting diodes positioned in each of the base recess wall opening and recess wall opening;

wherein upon powering the light emitting diodes light is emitted from the light emitting diode supported by the base wall and the light emitting diode supported by the conical shaped wall such light is cast in all directions; and, wherein there are a plurality of base recess walls that are arranged in the shape of a circle are spaced equal distances from one another and each supports one of the light emitting diodes, and there are a plurality of recess walls that are arranged in the shape of a ring and are spaced equal distances from one another and each supports one of the light emitting diodes.

2. The lighting unit according to claim 1 wherein disposed in the housing interior is a rechargeable battery and solar panel circuitry and wiring extends to the light emitting diodes, rechargeable battery and solar panel such that electrical power can be delivered from the rechargeable battery to the light emitting diodes.

3. The lighting unit according to claim 2 wherein the rechargeable battery is 3.7V and about 3500 mAh to about 5400 mAh and the solar panel is 5V and 420 mAh.

4. The lighting unit according to claim 1 wherein the base recess wall and recess wall have one of the following shapes: a conical shape; and, a sphere shape.

5. The lighting unit according to claim 1 wherein the solar panel support portion has a finial receiving extension that extends through the housing interior and defines a finial extension interior.

6. The lighting unit according to claim 5 wherein the finial extension has a finial extension end and the base wall defines a finial extension opening and the finial extension extends through the finial extension opening.

7. The lighting unit according to claim 1 wherein the recess walls are disposed midway between the solar panel support portion and the base wall such that light cast from the light emitting diodes is at an angle relative to the base wall and the solar panel support portion.

8. The lighting unit according to claim 1 wherein the acute angle is about forty-five degrees and further wherein the finial extension interior is sized such that it is capable of receiving a finial for use with a flagpole finial therein.

9. A lighting unit for use with a flagpole having a flag, the lighting unit comprising:

a housing having a solar panel support portion and a base portion and the solar panel support portion supports a solar panel and the solar panel support portion is supported on the base portion and the solar panel support portion and the base portion define a housing interior;

the base portion has a base wall having opposed interior and exterior base wall surfaces and a conical shaped wall having interior and exterior conical wall surfaces;

the base wall has a base recess wall that protrudes from the interior base wall surface and into the housing interior and wherein the base recess wall defines an base recess wall opening that leads to the housing interior;

the conical wall has a recess wall that protrudes from the interior conical wall surface and into the housing interior and wherein the recess wall defines a recess wall opening that leads to the housing interior;

and wherein the solar panel support portion has an interior surface and the interior conical shaped wall surface has an interior conical shaped wall surface, and the interior surface and interior conical shaped wall surface are at an acute angle;

light emitting diodes positioned in each of the base recess wall opening and recess wall opening;

wherein the base wall defines a finial extension opening and the solar panel support portion has a finial receiving extension that extends through the housing interior and the finial extension opening and the finial receiving extension defines a finial extension interior;

the flagpole having a flagpole finial wherein the finial has a shaft portion and a ball portion and wherein the shaft portion extends through the finial extension interior and into the flagpole such that the lighting unit is mounted on the flagpole;

wherein upon powering the light emitting diodes light is emitted from the light emitting diode supported by the base wall and the light emitting diode supported by the conical shaped wall such light is cast in all directions such the flag is illuminated when the is wind and when there is no wind; and, wherein there are a plurality of base recess walls that are arranged in the shape of a circle are spaced equal distances from one another and each supports one of the light emitting diodes, and there are a plurality of recess walls that are arranged in the shape of a ring and are spaced equal distances from one another and each supports one of the light emitting diodes.

10. The lighting unit according to claim 9 recess walls are disposed midway between the solar panel support portion and the base wall such that light cast from the light emitting diodes is at an angle relative to the base wall and the solar panel support portion.

11. The lighting unit according to claim 9 wherein the acute angle is about forty-five degrees.

12. A method for illuminating a flag with a lighting unit comprising the acts of:

providing a housing having a solar panel support portion and a base portion and supporting the solar panel support portion on the base portion and mounting a solar panel on the solar panel support portion and defining a housing interior with the solar panel support portion and the base portion;

providing the base portion with a base wall having opposed interior and exterior base wall surfaces and a conical shaped wall having interior and exterior conical wall surfaces;

providing the base wall with a base recess wall that protrudes from the interior base wall surface and into the housing interior and wherein the base recess wall defines an base recess wall opening that leads to the housing interior;

providing the conical wall with a recess wall that protrudes from the interior conical wall surface and into the housing interior and wherein the recess wall defines a recess wall opening that leads to the housing interior;

and providing the solar panel support portion with an interior surface and providing the interior conical shaped wall surface with an interior conical shaped wall surface and wherein the interior surface and interior conical shaped wall surface are at an acute angle;

positioning light emitting diodes positioned in each of the base recess wall opening and recess wall opening;

defining a finial extension opening in the base wall defines and the providing the solar panel support portion with a finial receiving extension that extends through the housing interior and the finial extension opening and the finial receiving extension defines a finial extension interior;

providing a flagpole having a flagpole finial and providing the finial with a shaft portion and a ball portion and extending the shaft portion through the finial extension interior and into the flagpole such that the lighting unit is mounted on the flagpole;

powering the light emitting diodes such that light is emitted from the light emitting diode supported by the base wall and the light emitting diode supported by the conical shaped wall such light is cast in all directions such the flag is illuminated when the is wind and when there is no wind; and, providing a plurality of base recess walls that are arranged in the shape of a circle and each supports a light emitting diode, and providing a plurality of recess walls that are arranged in the shape of a ring and are spaced from one another and each supports one of the light emitting diodes.

13. The method for illuminating a flag with a lighting unit lighting unit according to claim 12 wherein the recess walls are disposed midway between the solar panel support portion and the base wall such that light cast from the light emitting diodes is at an angle relative to the base wall and the solar panel support portion.

* * * * *